United States Patent [19]

Jerlich et al.

[11] Patent Number: 4,564,566

[45] Date of Patent: Jan. 14, 1986

[54] CHROMIUM CONTAINING ALLOY FOR FABRICATING PRESSING TOOLS, PRESSING PLATES FORMED FROM SUCH ALLOY AND METHOD OF FABRICATION THEREOF

[75] Inventors: Werner J. Jerlich, Mürzzuschlag; Hans Kaiserfeld, Krieglach; Alfred Kügler, Mürzzuschlag, all of Austria

[73] Assignee: Vereinigte Edelstahlwerke Aktiengesellschaft, Vienna, Austria

[21] Appl. No.: 618,938

[22] Filed: Jun. 8, 1984

[30] Foreign Application Priority Data

Jun. 28, 1983 [AT] Austria ..... 2359/83

[51] Int. Cl.[4] ..... C22C 39/00; C03B 9/00

[52] U.S. Cl. ..... 428/687; 428/685; 204/32.1; 204/129.1

[58] Field of Search ..... 428/687, 685; 204/32.1, 204/129.1

[56] References Cited

FOREIGN PATENT DOCUMENTS 2032366 11/1970 France .

OTHER PUBLICATIONS

Metals Handbook, 8th Ed., vol. 2, Heat Treating, Cleaning & Finishing, Am. Soc. Metals, Metals Park, Ohio, 1964, pp. 471 and 606.

*Primary Examiner*—Veronica O'Keefe

*Attorney, Agent, or Firm*—Werner W. Kleeman

[57] ABSTRACT

The pressure plate of a pressing tool is made of a chromium containing alloy essentially consisting of, each in percent by weight, carbon up to 0.3, silicon up to 1.0, manganese up to 1.5, chromium in the range of 11 to 17.2, molybdenum up to 1.5, nickel up to 6.0, copper up to 4.5, columbium up to 0.45, and nitrogen up to 0.10, the remainder being iron and impurities resulting from the melting conditions, wherein a chromium equivalent defined as the sum of % chromium + % molybdenum + 1.5 × % silicon × 0.5 × % columbium has a value smaller than or equal to 17.2, a nickel equivalent defined as the sum of % nickel + 0.5 × % manganese + 30 × % carbon + 20 × % nitrogen has a value greater than or equal to 4.65 the chromium equivalent to nickel equivalent ratio has a value smaller than or equal to 3.0 and the ferrite content is smaller or equal to 5%. The pressure plate is provided with a uniformly structured working surface by chemical or electrochemical etching.

17 Claims, No Drawings

CHROMIUM CONTAINING ALLOY FOR FABRICATING PRESSING TOOLS, PRESSING PLATES FORMED FROM SUCH ALLOY AND METHOD OF FABRICATION THEREOF

BACKGROUND OF THE INVENTION

The present invention relates to a new and improved chromium containing alloy for use as a pressing tool, especially a pressure plate, chemically or electrochemically treated pressing tools formed therefrom, and a method of fabricating such pressing tools.

Pressing tools and especially pressing plates comprise either a working surface which is burnished or polished to high luster in the event that the pressed object or article like, for example, a furniture plate is intended to inherently have a smooth surface or such pressing tools are structured so that the pressed article then has a comparable structured surface. It is required for the manufacture of such structured pressing tools, such as pressing tools including a polished planar surface, to first produce a surface which is as smooth as possible and only contains a slight roughness. Subsequently, the pressing tool is processed according to known methods like, for example, electrochemical or purely chemical methods. During such processing it is of particular significance that the material is removed in the desired amount. Even if there are only insignificant differences between the actual and the desired material removal, there will occur considerable flaws in the optical impression because in many cases the pressed material is intended to communicate the impression or appearance of a certain structure, for example, the graining of wood, be it in a processed state or in the original state, or a granular structure like that of sandstone or the like. When such article impression or appearance is flawed by non-uniform material removal from the pressing tool, then, the pressing tool generally can not be again reprocessed to possess the desired surface properties, wherefore such pressing tool must be rejected for further use.

As a material for the pressing plates burnished or high-luster polished chromium steels containing chromium in an amount of 11 to 17.5% have proven useful. When such chromium steels, however, are surface treated according to one of the conventional methods, for example, by etching, such pressure plates contain substantial structural imperfections.

SUMMARY OF THE INVENTION

Therefore, with the foregoing in mind, it is a primary object of the present invention to provide a chromium containing steel alloy for manufacturing pressing tools or the like which permits uniform surface structuring of such pressing tools.

Another and more specific object of the present invention is directed to the provision of a chromium containing steel alloy for manufacturing pressing tools or the like which permit uniform surface structuring of such pressing tools and which also have a long service life due to their chemical composition.

Still a further significant object of the invention is to provide a new and improved method of manufacturing pressing tools or the like by which pressing tools of such kind can be obtained in a simple manner which have an essentially uniform surface structure and a long service life.

Still another important object of the present invention is the provision of a new and improved pressing tool or the like which are surface-treated in a simple manner to yield an essentially uniform surface structure and which have a long service life due to their composition.

Now in order to implement these and still further objects of the invention, which will become more readily apparent as the description proceeds, the chromium containing alloy for fabricating pressing tools, especially pressure plates, of the present development is manifested by the features that, the chromium containing alloy for fabricating a pressing tool, especially, a pressure plate essentially consists of, each in percent by weight:

| | |
|---|---|
| carbon up to | 0.3 |
| silicon up to | 1.0 |
| manganese up to | 1.5 |
| chromium in the amount of | 11 to 17.2 |
| molybdenum up to | 1.5 |
| nickel up to | 6.0 |
| copper up to | 4.5 |
| columbium up to | 0.45 |
| nitrogen up to | 0.10, |

the remainder being iron and impurities resulting from the melting conditions.

In the chromium containing alloy a chromium equivalent is defined as the sum of % chromium + % molybdenum + 1.5 × % silicon + 0.5 × % columbium and has a value smaller than or equal to 17.2, a nickel equivalent is defined as the sum of % nickel + 0.5 × % manganese + 30 × % carbon + 20 × % nitrogen and has a value greater than or equal to 4.65 and the chromium equivalent to nickel equivalent ratio has a value smaller than or equal to 3.0. The chromium containing alloy further contains ferrite in an amount smaller than or equal to 5%.

The method of fabricating such pressing tools contemplates using the aforementioned alloy to form a pressing tool, and chemically or electrochemically treating such pressing tool to form an essentially uniform or regular surface structure.

It has been surprisingly found that a chromium containing alloy having the composition given above is excellently suited for the manufacture of etched pressing tools since, on the one hand, conventional etching methods can be readily used and, on the other hand, the entire surface formed by the alloy is uniformly etchable.

A chromium containing alloy which can be subjected to quenching and tempering and thereafter permits uniform material removal, essentially consists of, each in percent by weight:

| | |
|---|---|
| carbon in the range of | 0.02 to 0.23 |
| silicon up to | 1.00 |
| manganese up to | 1.00 |
| chromium in the range of | 11.5 to 13.2 |
| molybdenum up to | 0.6 |
| nickel up to | 1.0 |
| nitrogen up to | 0.1 |
| the remainder being iron. | |

Therein the chromium equivalent defined as the sum of % chromium + % molybdenum + 1.5 × silicon has a value smaller than or equal to 13.2, the nickel equivalent defined as the sum of % nickel + 0.5 × % manganese + 30 × % carbon + 20 × % nitrogen has a value greater than or equal to 4.65 and the chromium equivalent to nickel equivalent ratio is smaller than or equal to 2.85. The ferrite content of the chromium containing alloy is smaller than or equal to 5%.

A hardenable chromium containing alloy which also permits uniform material removal essentially consists of, each in percent by weight:

| | |
|---|---|
| carbon up to | 0.06 |
| silicon up to | 1.00 |
| manganese up to | 1.5 |
| chromium in the range of | 13.5 to 17.2 |
| molybdenum up to | 1.5 |
| nickel in the range of | 3.0 to 6.0 |
| copper in the range of | 1.5 to 4.5 |
| columbium in the range of | 0.15 to 0.45 |
| nitrogen up to | 0.10, |
| the remainder being iron. | |

Therein the chromium equivalent defined as the sum of % chromium+% molybdenum+1.5×% silicon+0.5×% columbium is smaller than or equal to 17.2, the nickel equivalent defined as the sum of % nickel+0.5×% manganese+30×% carbon+20×% nitrogen is greater than or equal to 5.3 and the chromium equivalent to nickel equivalent ratio is smaller than or equal to 3.00. The ferrite content is smaller than or equal to 5%.

DETAILED DESCRIPTION OF THE PREFERRED EMBODIMENTS

The invention will still better be understood and objects other than those set forth above, will become apparent when consideration is given to the following detailed examples. All percents are given in percent by weight unless specifically otherwise indicated.

EXAMPLE 1

A sheet metal plate composed of the alloy A as given in Table 1, appearing hereinafter, has the dimensions 300×200×2 mm and has a roughness in the range of 0.5 to 0.8μ in accordance with DIN 4768 RZ (German Industrial Standard). The sheet metal plate was quenched and tempered by first heating to a temperature of about 970° C., subsequently cooled in an oil bath, thereafter heated to about 700° C. and maintained for 30 minutes at that temperature and then the plate was allowed to cool in air. The sheet metal plate which was quenched and tempered in this manner was introduced into an etching container charged with a 6% aqueous iron-III-chloride solution. The etching solution was circulated and kept at a temperature of about 60° C. The sheet metal plate was removed from the etching solution after about 120 minutes, washed with distilled water and dried by means of hot air. The roughness was in the range of 5 to 6μ. However, under oblique light incidence there was observed a highly non-uniform material removal resulting in a reticulate structure.

EXAMPLES 2 AND 3

As will be evident from Table 2 given hereinafter the experiments in these examples were also conducted using the 6% aqueous iron chloride solution. The experimental arrangement was the same as in Example 1 and the roughness measured prior and after the action of the etching solution were identical to those obtained in Example 1.

In the case of the alloy C there could also be observed a material removal which was non-uniform at different locations and which became distinctly visible under oblique incidence of light. In the case of the alloy B according to Table 1 the material removal was completely uniform as observed under oblique incidence of light.

The roughness according to German Industrial Standard 4768 merely represents a measure of large-area surface conditions, however, constitutes no criterion with respect to local unevenness resulting, for example, from etching.

EXAMPLE 4

A sheet metal plate as in Example 1 was introduced into an etching container holding an about 76.5% aqueous orthophosphoric acid solution containing about 7.4% of chromium trioxide. Furthermore, a platinum electrode was arranged in the etching container. The sheet metal plate to be etched was connected as the anode and the platinum electrode which was of a reticulate structure was connected as the cathode. The current density was adjusted to 1 ampere per $cm^2$ and the temperature was about 25° C. After about 100 minutes the etched sheet metal plate was removed from the solution, washed with distilled water and dried using hot air. The roughness only was in the range of 0.3 to 0.4μ. There was present a highly non-uniform material removal with the formation of individual protruding structural elements.

EXAMPLE 5

A pressure plate was prepared from a chromium steel alloy having the composition as given at D in Table 1. Such a pressure plate had the same dimensions and the surface thereof had the same properties as in Example 1. The pressure plate was quenched and tempered as in Example 1. Subsequently, the pressure plate was etched according to the method described with respect to Example 4. Under these conditions a completely uniform material removal was obtained and the surface appeared lackluster. Even under oblique incidence of light there could not be discerned any non-uniform structures.

EXAMPLE 6

A sheet metal plate having the composition as given at E in Table 1 had the dimensions as given in Example 1. The sheet metal plate was heat treated by solution heating to 150° C., subsequently water cooled, hardened at about 480° C. for 2 hours and subsequently cooled in air. The pressure plate was etched in a 15% nitric acid containing 3% hydrofluoric acid at about 50° C. for about 100 minutes. There was a non-uniform material removal resulting in a striped structure which was clearly visible particularly under oblique incidence of light. The roughness was in the range of 5 to 6μ according to German Industrial Standard 4768 RZ.

EXAMPLE 7

A sheet metal plate having the dimensions as in Example 1 had the composition J as given in Table 1. The pressure plate was etched in the etching apparatus as described with respect to Example 1 using an etching solution as described in Example 6 at a temperature of about 50° C. for about 100 minutes. The roughness corresponded to that of the sheet metal plate of Example 6, however, even when viewed under oblique incidence of light there was uniform material removal.

EXAMPLE 8

A sheet metal plate having the dimensions as given in Example 1 had the composition G as given in Table 1. The pressure plate was electrochemically etched corresponding to Example 4. The roughness prior to the etching operation was in the range of 0.5 to 0.8, however, after etching was in the range of 0.15 to 0.3μ. However, the material removal was non-uniform and the thus treated surface of the plate contained a striped structure which was particularly clearly discernible under oblique illumination.

EXAMPLE 9

A sheet metal plate had the analogous dimensions as the sheet metal plate in Example 8 and was heat treated analogous to Example 8. The sheet metal plate had a composition according to the alloy designated H in Table 1 and the procedure was as in Example 8. There was observed a uniform material removal and the surface showed a dull luster and a roughness in the range of 0.15 to 0.3μ. Even under oblique illumination there could be demonstrated no irregular structures, particularly no deeper depressions and the like.

EXAMPLE 10

An alloy having the composition G as given in Table 1 was subjected to a heat treatment as described with respect to Example 6. The pressure plate was etched in the apparatus as described in Example 4, using a 5% aqueous hydrochloric acid and a current density of 1 ampere per $cm^2$ at about 25° C. After the etching operation the roughness of the sheet metal plate was in the range of 0.4 to 0.8μ. A totally non-uniform material removal had taken place and the surface looked striped and grained which was clearly and distinctly visible particularly under oblique illumination.

EXAMPLE 11

A sheet metal plate having the composition as given under H in Table 1 was treated in accordance with the procedure as described with respect to Example 10. There could be observed a completely uniform material removal as a result of which the surface appeared in a dull gray and the roughness thereof after etching was to in the range of 0.4 to 0.8μ. Even under oblique illumination no non-uniform structuring could be observed.

EXAMPLE 12

A sheet metal plate having the composition as given under F in Table 1 was subjected to the heat treatment as described with respect to Example 6. Subsequently, the sheet metal plate was etched as described with respect to Example 1. The roughness prior to etching was in the range of 0.5 to 0.8 and, after etching, in the range of 0.4 to 0.8μ. However, after etching, the surface was totally non-uniform and of a striped structure in which local depressions appeared.

EXAMPLE 13

A sheet metal plate having the composition as given under J in Table 1 was treated analagously to Example 12. After etching the roughness was in the range of 0.4 to 0.8μ. There was a completely uniform material removal and even under oblique illumination there could not be detected any non-uniform structuring.

TABLE 1

CHEMICAL COMPOSITION DATA OF THE CHROMIUM CONTAINING ALLOYS INVESTIGATED

| | CHEMICAL COMPOSITION IN % BY WEIGHT | | | | | | | | | Chromium | Nickel | Cr—Equiv. | Average Ferrite |
|---|---|---|---|---|---|---|---|---|---|---|---|---|---|
| Steel | C | Si | Mn | Cr | Mo | Ni | N | Cu | Nb | Equivalent | Equivalent | Ni—Equiv. | Content, % |
| A | 0.10 | 0.46 | 0.30 | 13.41 | — | 0.20 | 0.019 | — | — | 14.10 | 3.73 | 3.78 | 26 |
| B | 0.12 | 0.32 | 0.44 | 12.67 | — | 0.54 | 0.016 | — | — | 13.15 | 4.68 | 2.81 | 5 |
| C | 0.13 | 0.35 | 0.30 | 12.48 | 0.23 | 0.28 | 0.016 | — | — | 13.24 | 4.65 | 2.85 | 8 |
| D | 0.15 | 0.16 | 0.44 | 11.56 | 0.04 | 0.47 | 0.015 | — | — | 11.84 | 5.49 | 2.16 | 1 |
| E | 0.020 | 0.42 | 0.84 | 16.21 | 0.25 | 3.62 | 0.012 | 3.51 | 0.28 | 17.23 | 4.88 | 3.53 | 12 |
| F | 0.043 | 0.58 | 0.91 | 16.62 | 0.20 | 3.73 | 0.024 | 3.67 | 0.38 | 17.88 | 5.96 | 3.00 | 8 |
| G | 0.024 | 0.53 | 0.93 | 16.63 | 0.22 | 3.80 | 0.023 | 3.65 | 0.38 | 17.84 | 5.45 | 3.27 | 15 |
| H | 0.032 | 0.17 | 0.44 | 15.77 | 0.20 | 4.76 | 0.022 | 3.21 | 0.26 | 16.36 | 6.38 | 2.56 | 1 |
| J | 0.028 | 0.46 | 0.37 | 15.85 | 0.18 | 4.54 | 0.026 | 3.14 | 0.23 | 16.83 | 6.09 | 2.76 | 3 |

Chromium Equivalent: % chromium + % molybdenum + 1.5 × % silicon + 0.5 × % columbium
Nickel Equivalent: % nickel + 0.5 × % manganese + 30 × % carbon + 20 × % nitrogen

TABLE 2

SUMMARY OF THE SURFACE TREATMENT RESULTS

| EXAMPLE NO. | STEEL | ETCHING SOLUTION in % per weight | EXPERIMENTAL CONDITIONS | RESULTS |
|---|---|---|---|---|
| 1 | A | 6% $FeCl_3$<br>Remainder:Water | Temperature 60° C. | Pronouned non-uniform removal<br>Reticulate structure |
| 2 | C | | | Locally non-uniform removal |
| 3 | B | | | Uniform removal |
| 4 | A | 76.5% $H_3PO_4$ | Temperature 25° C. | Pronounced non-uniform removal |
| 5 | D | 7.4% $CrO_3$<br>Remainder:Water | Electrochemical<br>Current Density 1 A/$cm^2$ | Uniform removal with dull surface |
| 6 | E | 15% $HNO_3$<br>3% HF | Temperature 50° C. | Non-uniform removal, striped structure |
| 7 | J | Remainder:Water | | Uniform removal |
| 8 | G | 76.5% $H_3PO_4$<br>7.4% $CrO_3$ | Temperature 25° C.<br>Electrochemical | Non-uniform removal, striped structure |
| 9 | H | Remainder:Water | Current Density 1 A/$cm^2$ | Uniform removal, lackluster surface |
| 10 | G | 5% HCl<br>Remainder:Water<br>Current Density 1 A/$cm^2$ | Temperature 25° C.<br>Electrochemical | Non-uniform removal, surface striped and grained |
| 11 | H | | | Uniform removal, surface dull gray |
| 12 | F | 6% $FeCl_3$<br>Remainder:Water | Temperature 60° C. | Non-uniform removal, surface striped with local holes |

TABLE 2-continued

| SUMMARY OF THE SURFACE TREATMENT RESULTS | | | | |
|---|---|---|---|---|
| EXAMPLE NO. | STEEL | ETCHING SOLUTION in % per weight | EXPERIMENTAL CONDITIONS | RESULTS |
| 13 | J | | | Uniform removal |

Table 1 lists the chemical composition of stainless martensitic chromium steels designated A to D and of stainless hardenable chromium steels designated E to J with differently high ferrite contents. In the etching experiments under the conditions as enumerated in Table 2, material the removal is only uniform when the ferrite content does not exceed 5%.

While there are described present preferred embodiments of the invention, it is to be distinctly understood that the invention is not limited thereto, but may be otherwise variously embodied and practiced within the scope of the following claims.

Accordingly, what we claim is:

1. A method of using a stainless hardenable chromium steel essentially consisting of, each in percent by weight:

| | | |
|---|---|---|
| carbon | up to | 0.3 |
| silicon | up to | 1.0 |
| manganese | up to | 1.5 |
| Chromium in the amount of | | 11 to 17.2 |
| molybdenum | up to | 1.5 |
| nickel | up to | 6.0 |
| copper | up to | 4.5 |
| columbium | up to | 0.45 |
| nitrogen | up to | 0.10 |
| the remainder being iron and impurities resulting from the melting conditions; | | |

said chromium alloy containing ferrite in an amount smaller than or equal to 5% by weight, wherein a chromium equivalent defined as the sum of % chromium+% molybdenum+1.5×% silicon+0.5×% columbium has a value smaller than or equal to 17.2, a nickel equivalent defined as the sum of % nickel+0.5×% manganese+30×% carbon+20×% nitrogen has a value greater than or equal to 4.65 and the chromium equivalent to nickel equivalent ratio has a value smaller than or equal to 3.0; and for producing a pressure plate of a pressing tool containing a structured working surface.

2. The method as defined in claim 1, further including the step of:

structuring said working surface by chemical etching.

3. The method as defined in claim 1, further including the step of:

structuring said working surface by electrochemical etching.

4. The method as defined in claim 1, further including the step of:

using a stainless hardenable chromium steel essentially consisting of, each in percent by weight:

| | |
|---|---|
| carbon up to | 0.06 |
| silicon up to | 1.00 |
| manganese up to | 1.5 |
| chromium in the range of | 13.5 to 17.2 |
| molybdenum up to | 1.5 |
| nickel in the range of | 3.0 to 6.0 |
| copper in the range of | 1.5 to 4.5 |
| columbium in the range of | 0.15 to 0.45 |

-continued

| | |
|---|---|
| nitrogen up to | 0.10, |
| the remainder being iron and impurities resulting from the melting conditions | |

5. A method of using a stainless martensitic chromium steel essentially consisting of, each in percent by weight:

| | |
|---|---|
| carbon in the range of | 0.02 to 0.23 |
| silicon up to | 1.00 |
| manganese up to | 1.00 |
| chromium in the range of | 11.5 to 13.2 |
| molybdenum up to | 0.6 |
| nickel up to | 1.0 |
| nitrogen up to | 0.10, |

the remainder being iron and impurities resulting from the melting conditions;

wherein a chromium equivalent defined as the sum of % chromium+% molybdenum+1.5×% silicon has a value smaller than or equal to 13.2, a nickel equivalent defined as the sum of % nickel+0.5×% manganese+30×% carbon+20×% nitrogen has a value greater than or equal to 4.65 and the chromium equivalent to nickel equivalent ratio has a value smaller than or equal to 2.85;

said chromium steel containing ferrite in an amount smaller than or equal to 5% by weight;

for producing a pressure plate of a pressing tool containing a structured working surface.

6. The method as defined in claim 5, further including the step of:

structuring said working surface by chemical etching.

7. The method as defined in claim 5, further including the step of:

structuring said working surface by electrochemical etching.

8. A method of manufacturing a pressing tool, especially a pressure plate, including the steps of:

using a stainless hardenable chromium steel essentially consisting of, each in percent by weight:

| | | |
|---|---|---|
| carbon | up to | 0.3 |
| silicon | up to | 1.0 |
| manganese | up to | 1.5 |
| Chromium in the amount of | | 11 to 17.2 |
| molybdenum | up to | 1.5 |
| nickel | up to | 6.0 |
| copper | up to | 4.5 |
| columbium | up to | 0.45 |
| nitrogen | up to | 0.10 |
| the remainder being iron and impurities resulting from the melting conditions; | | |

said chromium alloy containing ferrite in an amount of smaller than or equal to 5% by weight, wherein a chromium equivalent defined as the sum of % chromium+% molybdenum+1.5×% silicon+0.5×% columbium has a value smaller than or equal to 17.2, a nickel equivalent defined as the sum of % nickel+0.5×% manganese+30×% carbon+20×% nitrogen has a value greater than or equal to 4.65 and the chromium equivalent to nickel equivalent ratio has a value smaller than or equal to 3.0;

forming a pressure plate from such stainless hardenable chromium steel; and etching said pressure plate in order to obtain an essentially uniformly structured working surface of said pressure plate.

9. The method as defined in claim 8, wherein:

the step of etching said pressure plate includes the step of chemically etching said pressure plate.

10. The method as defined in claim 8, wherein:

the step of etching said pressure plate includes the step of electrochemically etching said pressure plate.

11. The method as defined in claim 8, further including the step of:

using a stainless hardenable chromium steel essentially consisting of, each in percent by weight:

| | |
|---|---|
| carbon up to | 0.06 |
| silicon up to | 1.00 |
| manganese up to | 1.5 |
| chromium in the range of | 13.5 to 17.2 |
| molybdenum up to | 1.5 |
| nickel in the range of | 3.0 to 6.0 |
| copper in the range of | 1.5 to 4.5 |
| columbium in the range of | 0.15 to 0.45 |
| nitrogen up to | 0.10, |
| the remainder being iron and impurities resulting from the melting conditions | |

the chromium equivalent to nickel equivalent ratio therein having a value smaller than or equal to 3.00.

12. A method of manufacturing a pressing tool, especially a pressure plate, including the steps of:

using a stainless martensitic chromium steel essentially consisting of, each in percent by weight:

| | |
|---|---|
| carbon in the range of | 0.02 to 0.23 |
| silicon up to | 1.00 |
| manganese up to | 1.00 |
| chromium in the range of | 11.5 to 13.2 |
| molybdenum up to | 0.6 |
| nickel up to | 1.0 |
| nitrogen up to | 0.10, |
| the remainder being iron and impurities resulting from melting conditions; | |

wherein a chromium equivalent defined as the sum of % chromium+% molybdenum+1.5×% silicon has a value smaller than or equal to 13.2, a nickel equivalent defined as the sum of % nickel+0.5×% manganese+30×% carbon+20×% nitrogen has a value greater than or equal to 4.65 and the chromium equivalent to nickel equivalent ratio has a value smaller than or equal to 2.85;

said chromium steel containing ferrite in an amount smaller than or equal to 5% by weight;

forming a pressure plate from such stainless martensitic chromium steel; and etching said pressure plate thus formed in order to obtain an essentially uniformly structured working surface at said pressure plate.

13. The method as defined in claim 12, wherein:

the step of etching the pressure plate includes the step of chemically etching said pressure plate.

14. The method as defined in claim 7, wherein:

the step of etching the pressure plate includes the step of electrochemically etching said pressure plate.

15. A pressure plate of a pressing tool comprising:

a working surface having a chemically or electrochemically etched structure; and said pressure plate being made of a stainless hardenable chromium steel essentially consisting of, each in percent by weight:

| | |
|---|---|
| carbon up to | 0.3 |
| silicon up to | 1.0 |
| manganese up to | 1.5 |
| chromium in the amount of | 11 to 17.2 |
| molybdenum up to | 1.5 |
| nickel up to | 6.0 |
| copper up to | 4.5 |
| columbium up to | 0.45 |
| nitrogen up to | 0.10, |
| the remainder being iron and impurities resulting from the melting conditions, | |

wherein a chromium equivalent defined as the sum of % chromium+% molybdenum+1.5×% silicon+0.5×% columbium has a value smaller than or equal to 17.2, a nickel equivalent defined as the sum of % nickel+0.5×% manganese+30×% carbon+20×% nitrogen has a value greater than or equal to 4.65 and the chromium equivalent to the nickel equivalent ratio has a value smaller than or equal to 3.0; and said chromium containing alloy containing ferrite in an amount smaller than or equal to 5% by weight.

16. The pressure plate as defined in claim 15, wherein:

said pressure plate is made of a stainless hardenable chromium steel essentially consisting of, each in percent by weight:

| | |
|---|---|
| carbon up to | 0.06 |
| silicon up to | 1.00 |
| manganese up to | 1.5 |
| chromium in the range of | 13.5 to 17.2 |
| molybdenum up to | 1.5 |
| nickel in the range of | 3.0 to 6.0 |
| copper in the range of | 1.5 to 4.5 |
| columbium in the range of | 0.15 to 0.45 |
| nitrogen up to | 0.10, |
| the remainder being iron and impurities resulting from the melting conditions | |

17. A pressure plate of a pressing tool comprising:

a working surface having a chemically or electrochemically etched structure; and said pressure plate being made of a stainless martensitic chromium steel essentially consisting of, each in percent by weight:

| | |
|---|---|
| carbon in the range of | 0.02–0.23 |
| silicon up to | 1.00 |
| manganese up to | 1.00 |
| chromium in the range of | 11.5 to 13.2 |
| molybdenum up to | 0.6 |
| nickel up to | 1.0 |
| nitrogen up to | 0.10 |
| the remainder being iron and impurities resulting from the melting conditions; | |

wherein a chromium equivalent defined as the sum of % chromium+% molybdenum+1.5×% silicon has a value smaller than or equal to 13.2, a nickel equivalent defined as the sum of % nickel+0.5×% manganese+30×% carbon+20×% nitrogen has a value greater than or equal to 4.65 and the chromium equivalent to nickel equivalent ratio has a value smaller than or equal to 2.85; and said chromium steel containing ferrite in an amount smaller than or equal to 5% by weight.

* * * * *